US007860711B2

(12) United States Patent
Sung et al.

(10) Patent No.: US 7,860,711 B2
(45) Date of Patent: Dec. 28, 2010

(54) TRANSMITTER AND RECEIVER FOR SPEECH CODING AND DECODING BY USING ADDITIONAL BIT ALLOCATION METHOD

(75) Inventors: Ho-Sang Sung, Daejeon (KR); Dae-Hwan Hwang, Daejeon (KR); Dae-Hee Youn, Seoul (KR); Hong-Goo Kang, Seoul (KR); Young-Cheol Park, Wonjoo (KR); Ki-Seung Lee, Seoul (KR); Sung-Kyo Jung, Seoul (KR); Kyung-Tae Kim, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 314 days.

(21) Appl. No.: 12/071,587

(22) Filed: Feb. 22, 2008

(65) Prior Publication Data

US 2008/0162124 A1 Jul. 3, 2008

Related U.S. Application Data

(63) Continuation of application No. 10/606,540, filed on Jun. 26, 2003, now Pat. No. 7,346,503.

(30) Foreign Application Priority Data

Dec. 9, 2002 (KR) ..... 10-2002-0077996

(51) Int. Cl.
*G10L 19/00* (2006.01)

(52) U.S. Cl. ..... 704/220; 704/201

(58) Field of Classification Search ..... 704/220, 704/201

See application file for complete search history.

(56) References Cited

U.S. PATENT DOCUMENTS

| | | | | |
|---|---|---|---|---|
| 5,937,378 | A | 8/1999 | Serizawa | 704/230 |
| 6,377,916 | B1 * | 4/2002 | Hardwick | 704/208 |
| 6,658,378 | B1 * | 12/2003 | Maeda | 704/200.1 |
| 7,047,186 | B2 * | 5/2006 | Oishi | 704/205 |
| 2005/0171770 | A1 * | 8/2005 | Yamaura | 704/219 |

OTHER PUBLICATIONS

Sean A. Ramprashad, "A Two Stage Hybrid Embedded Speech/Audio coding Structure", 0-7803-4428-6/98, 1998 IEEE, pp. 337-340.

U.S. Appl. No. 10/606,540, filed Jun. 26, 2003, Ho-Sang Sung et al., Electronics and Telecommunications Research Institute.

U.S. Office Action mailed Jan. 30, 2007 in corresponding U.S. Appl. No. 10/606,540.

Notice of Allowance mailed Oct. 26, 2007 in corresponding U.S. Appl. No. 10/606,540.

* cited by examiner

*Primary Examiner*—Jakieda R Jackson
(74) *Attorney, Agent, or Firm*—Staas & Halsey LLP

(57) ABSTRACT

The present invention relates to a transmitter and a receiver for speech coding and decoding by using an additional bit allocation method. The transmitter and the receiver according to the present invention realize a voice communication service of high quality by using additional bits permitted in system requirements while using a conventional speech coder as it is. In addition, the transmitter and the receiver according to the present invention have an advantage in that they enable insertion of additional quantization blocks while not changing the structure of the conventional standard speech coder, since they allocate additional bits by applying a multi-stage quantization procedure not in a speech signal domain but in a parameter domain.

10 Claims, 5 Drawing Sheets

TRANSMITTER AND RECEIVER FOR SPEECH CODING AND DECODING BY USING ADDITIONAL BIT ALLOCATION METHOD

CROSS-REFERENCE TO RELATED APPLICATIONS

This application is a U.S. continuation application filed under 35 USC 1.53(b) claiming benefit of U.S. Ser. No. 10/606,540 filed in the United States on Jun. 26, 2003, now U.S. Pat. No. 7,346,503 which claims earlier benefit of Korean Patent Application No. 2002-77996 filed in Japan on Sep. 12, 2002, of which this application is hereby incorporated by reference.

BACKGROUND OF THE INVENTION

1. Field of the Invention

The present invention relates to a transmitter and a receiver for speech coding and decoding by using an additional bit allocation method. More specifically, the present invention relates to a transmitter and a receiver using an additional bit allocation method while maintaining bit compatibility so as to improve performance of a conventional speech coder. The transmitter and the receiver according to the present invention may be applicable to a VoIP (Voice-Over Internet Protocol) communication system.

2. Description of the Related Art

Various coding methods have been proposed to convert a voice signal into a digital signal and process the digitalized voice signals. Most popular coding methods may be classified as a waveform coding method such as a PCM (pulse code modulation) method or a hybrid coding method. The hybrid coding method is a combination of a waveform coding method and a parametric coding method. For example, a CELP (code-exited linear prediction) method that is recommended as a standard of ITU-T (International Telecommunication Union—Telecommunication standardization sector) may use the hybrid coding method. Most of the hybrid coding methods are based on a speech production model for effective compression of a voice signal. According to the hybrid coding methods, the voice signal is classified as an excited signal, and spectrum information represents a vocal tract transfer function. The classified spectrum information and the excited signal are respectively modeled and quantized with a predefined method. The quantized spectrum information and the excited signal are transmitted to a receiver. A representative hybrid coding method may be exemplified as an AMR (Adaptive Multi-Rate) coder. The AMR coder is scheduled to be used in the IMT-2000 communication system.

With reference to the G.723.1 standard, it is a standardized algorithm for compressing a multimedia signal by using a minimum number of bits. The G.723.1 algorithm compresses an input voice signal or restores an original uncompressed signal from the input voice signal at two bit rates, such as 5.3 kbit/s and 6.3 kbit/s. The G.723.1 algorithm also provides toll quality equal to the quality level required in a wired network. Similarly, the G.729 algorithm compresses an input voice signal or restores an original uncompressed signal from the input voice signal at a bit rate of 8 kbit/s, and it also provides toll quality equal to the quality level required in a wired network. The G.729 algorithm is widely used in the VoIP application field together with the G.723.1 algorithm. Moreover, the G.729A algorithm is also widely used because it has reduced complexity and has bit compatibility with the G.729 algorithm that requires much computation ability for effective realization. Furthermore, an AMR coder is proposed for the next generation voice communication. There are AMR-NB (AMR-narrowband) coder for processing a telephone band voice signal and AMR-WB (AMR-wideband) for processing a wideband signal.

The above-described voice coders are presently used or scheduled to be used in a wired and wireless voice communication system. The above voice coders quantize spectrum information of voice signals and excited signal information by using a CELP algorithm on the basis of a speech production model. However, there is a problem in that performance deterioration arises in transition frame or with respect to any signal except a voice signal, such as a music signal, since the coders use restricted bit rates. In particular, the G.729 algorithm has a frame size of 10 ms for analyzing parameters, which is less than that of other coders. Accordingly, the G.729 algorithm is appropriate for modeling of the excited signal, but it has a problem in quantization of spectrum information such as LPC. This is because the number of bits to be allocated as linear prediction coefficients (LPC) for quantization in the G.729 algorithm is relatively small.

However, the G.723.1 algorithm has a frame size of 30 ms, which is relatively large. In the case of the G.723.1 algorithm, a sufficient numbers of bits are used for LPC quantization, thus the distortion of the quantized information is reasonable. However, since the G.723.1 uses a linear interpolation method implemented at each interval of the sub-frames, a problem of distortion of spectrum information becomes larger at each sub-frame. In the search duration of a fixed codebook for representing non-periodic excited signals of the coders using the two algorithms, an algebraic codebook comprised of a few pulses is used. Therefore, a problem arises in that the quality is degraded due to a deficiency of the number of pulses for representing the excited signals in any duration, such as the transition duration, whereby performance of an adaptive codebook is degraded.

SUMMARY OF THE INVENTION

It is an advantage of the present invention to provide a transmitter and a receiver realizing a voice communication service of high quality by using additional bits permitted in system requirements while maintaining bit compatibility with a conventional standardized speech coder.

It is another advantage of the present invention to provide a transmitter and a receiver where additional bits are not allocated to a speech signal domain but rather to a parameter domain such as an LSP quantization procedure, an LSP interpolation procedure, and a quantization procedure of an excited signal, thereby improving quantization performance with a minimized number of bits.

It is still another advantage of the present invention to provide a transmitter and a receiver for cascaded speech coding and decoding algorithms that enhance the perceptual quality of standard coders, thereby providing a voice communication service with high quality through additional bit allocation while maintaining bit compatibility with a conventional speech coder.

In accordance with one aspect of the present invention, a transmitter for speech coding and decoding by using an additional bit allocation method comprises:

a standard speech coder for receiving a speech signal while dividing the speech signal into spectrum information representing a vocal tract function and an excited signal component and generating standard coded bit streams by performing modeling, quantizing, and coding with respect to the spectrum information and the excited signal;

a quality enhancement coder for obtaining errors between the quantized signal and the desired signal with respect to each of the spectrum information and the excited signal component, and generating coded bit streams by performing additional quantization with respect to the obtained errors; and, a multiplexing block for multiplexing the bit streams obtained at each of the coders and transmitting the multiplexed bit streams to a receiver.

In accordance with another aspect of the present invention, a receiver for speech coding and decoding by using an additional bit allocation method comprises:

a demultiplexing block for receiving bit streams of a speech signal and demultiplexing the bit streams of the speech signal to generate an LSP index and an additional LSP index on spectrum information of the speech signal, and an excited signal index and an additional excited signal index on an excited signal component of the speech signal;

a standard speech decoder for receiving the multiplexed index signals, performing a dequantization procedure with respect to spectrum information and an excited component of the speech signal and restoring the speech signal by combining the dequantized spectrum information and excited signal component with a corresponding error component of the spectrum information and the excited signal; and, a quality enhancement decoder for receiving the additional LSP index and the additional excited signal index and generating error compensated components of the spectrum information and the excited signal by performing a dequantization procedure with respect to the additional LSP index and the additional excited signal index.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
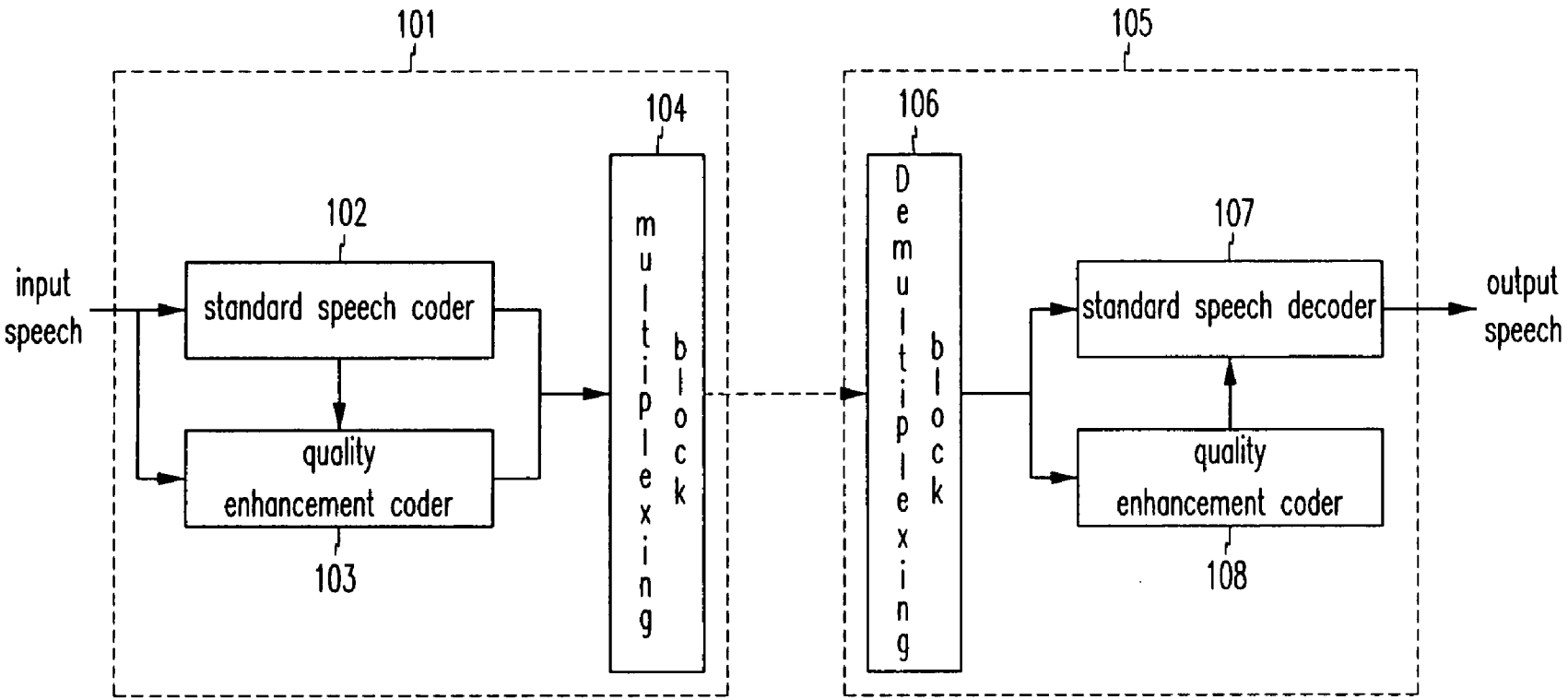
FIG. 1 illustrates an overall structure of a transmitter and a receiver where a speech coding and decoding method has been adapted in accordance with the present invention.

In FIG. 1, an overall structure of a transmitter and a receiver where a speech coding and decoding method according to the present invention has been adapted is illustrated. The transmitter and the receiver shown in FIG. 1 comprise a transmitting block 101 and a receiving block 105. The transmitting block 101 includes a standard speech coder 102, a quality enhancement coder 103, and a multiplexing block 104. The quality enhancement coder 103 performs bit expansion while maintaining bit compatibility with the standard speech coder 102. An input speech signal is inputted to the standard speech coder 102, and the standard speech coder 102 performs a coding procedure in accordance with conventional standards. The quality enhancement coder 103 performs a quantization procedure through a multi-stage quantization method, which quantizes the error by using additional bits. The standard speech coder 102 and the quality enhancement coder 103 output bit streams, and the bit streams are multiplexed by the multiplexing block 104 which is preset to maintain bit compatibility with the standard speech coder 102. Then, the multiplexed signal is transmitted to the receiving block 105. The receiving block 105 comprises a demultiplexing block 106, a standard speech decoder 107, and a quality enhancement decoder 108. The demultiplexing block 106 receives the bit stream from the transmitting block 101 and performs a demultiplexing procedure. By this demultiplexing procedure, the bit stream is divided into two bit streams, one of which is sent to the standard speech decoder 107 and the other is sent to the quality enhancement decoder 108. Decoding procedures of the corresponding input bit stream are respectively performed in the standard speech decoder 107 and the quality enhancement decoder 108, and thus a restored voice may be finally obtained.

Figure 2:
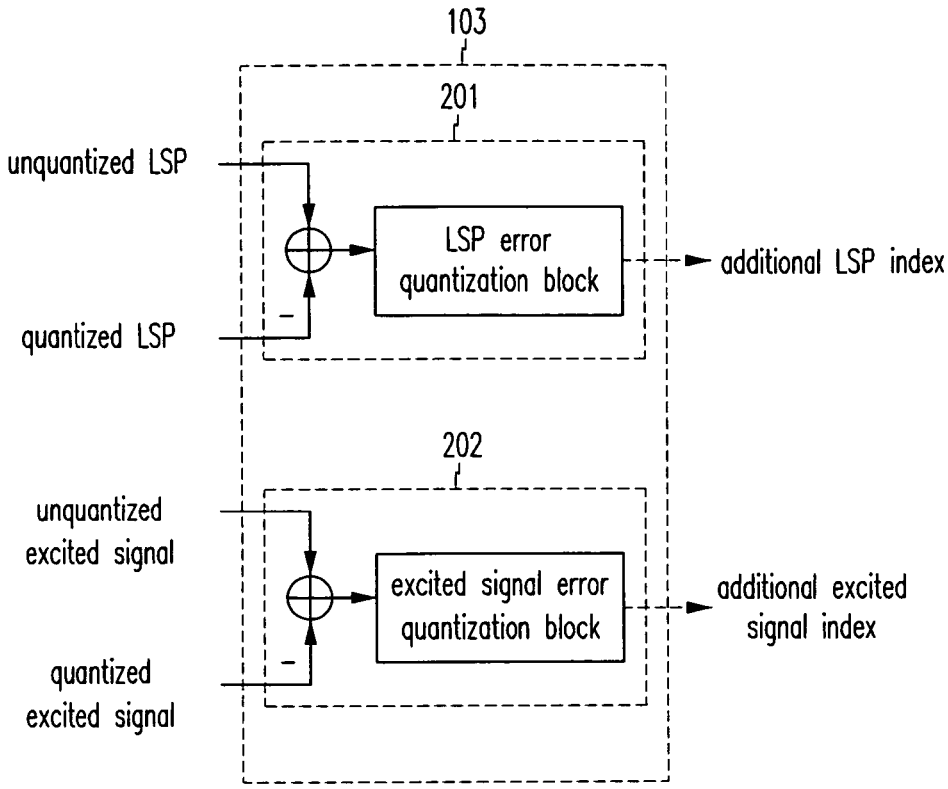
FIG. 2 illustrates a detailed configuration of a quality enhancement coder shown in FIG. 1.

In FIG. 2, a detailed configuration of the quality enhancement coder 103 shown in FIG. 1 is illustrated. As shown in FIG. 2, the quality enhancement coder 103 primarily comprises an LSP (line spectrum pairs) error quantization block 201 for representing a vocal tract function, as well as an excited signal error quantization block 202 for modeling an excited signal. An additional bit stream generated in the quality enhancement coder 103 is sent to the multiplexing block 104 in FIG. 1.

A detailed description of the LSP error quantization block 201 will be given in the following. Input signals of the LSP error quantization block 201 are an LSP parameter l(m) for quantizing linear prediction coefficient (LPC) information obtained at the standard speech coder 102, and a quantized LSP parameter l'(m). The LSP error quantization block 201 of the quality enhancement coder 103 performs an additional quantization procedure with respect to an error signal between the unquantized LSP parameter l(m) and the quantized LSP parameter l'(m) obtained at the standard speech coder 102, and outputs quantized bit streams into the multiplexing block 104. A scalar quantization method or a vector quantization method may be applicable to the additional quantization procedure. In the usual case, it is very effective to use the vector quantization method that is capable of obtaining superior performance by means of a minimum number of bits. Moreover, it is more advantageous for obtaining high performance to apply selective vector quantization with respect to coefficients representing quantization performance primarily obtained at the standard speech coder 102, instead of applying vector quantization with respect to all of the LSP coefficients. For example, after comparing quantization performance for each coefficient, we may apply additional quantization only to coefficients having poor quantization performance while not applying additional quantization to coefficients having good quantization performance. According to experiments, relatively good quantization performance is obtained even though only the standard speech coder 102 is used with respect to LSP coefficients having a low order. In this case, the quantization procedure at the quality enhancement coder 103 may be omitted.

Figure 3:
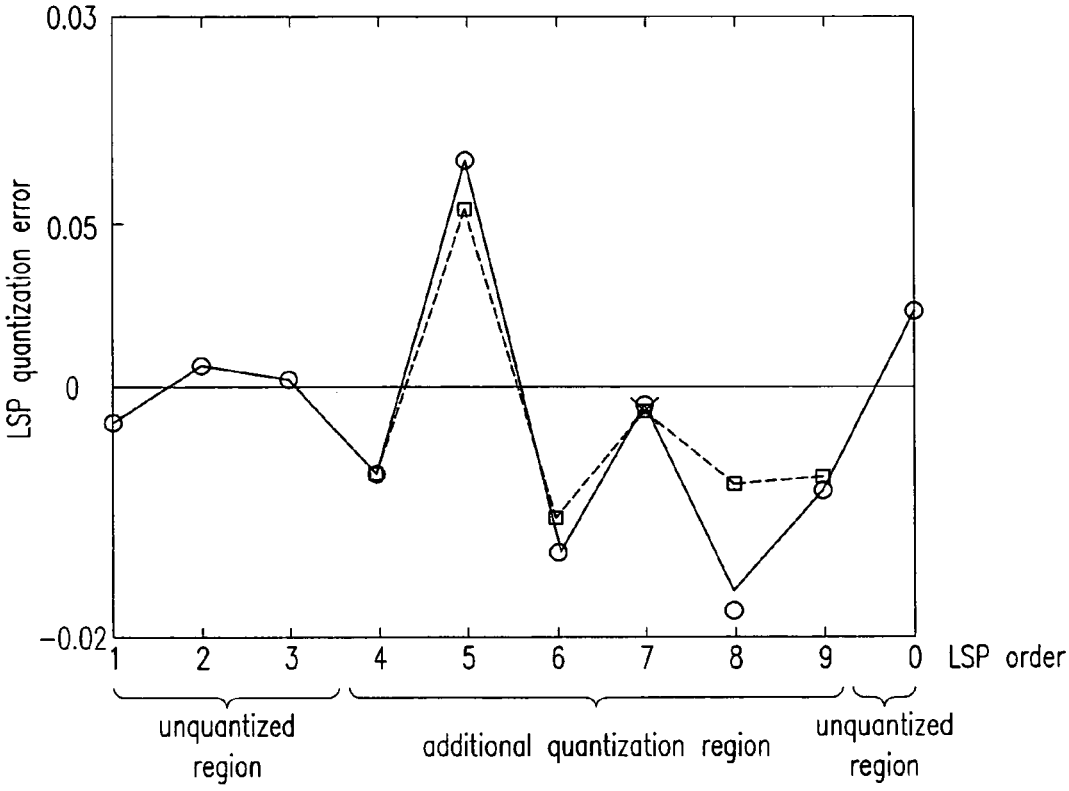
FIG. 3 illustrates a graph for describing a vector quantization method in accordance with the present invention.

FIG. 3 is illustrated to describe a quantization procedure at the LSP error quantization block 201. In FIG. 3, the dotted line represents the LSP quantization error obtained through an additional vector quantization procedure at the quality enhancement coder 103.

Next, the excited signal error quantization block 202 which forms another element of the quality enhancement coder 103 will be described in the following. Input signals of the excited signal error quantization block 202 are a target signal t(n) inputted from the standard speech coder 102 for quantization of the excited signal and a standard complex signal t'(n) obtained through combination of the target signal t(n) and a quantized excited signal outputted from the standard speech coder 102. The excited signal error quantization block 202 calculates errors between the two input signals and performs a multistage quantization procedure with respect to the calculated errors so that the tone quality of complex speech resulting from the multi-stage quantization may be improved. In the multi-stage quantization procedure, all of the fixed-codebook methods that are presently known may be applicable. However, it is effective to modify the method used in the standard speech coder 102 and use the modified method for reduction in system complexity, and program, data, and memory capacity. For example; in the case of a G.729A algorithm, it is preferable to use an algebraic codebook that has been standardized and is presently used. In the case of using an additional algebraic codebook, it may contribute to performance improvement of a speech coder to design the algebraic codebook by considering a relationship with the structure of the algebraic codebook used in the standard speech coder 102. Bit streams of a quantized excited signal obtained at the excited signal error quantization block 202 are outputted to the multiplexing block 104.

Figure 4:
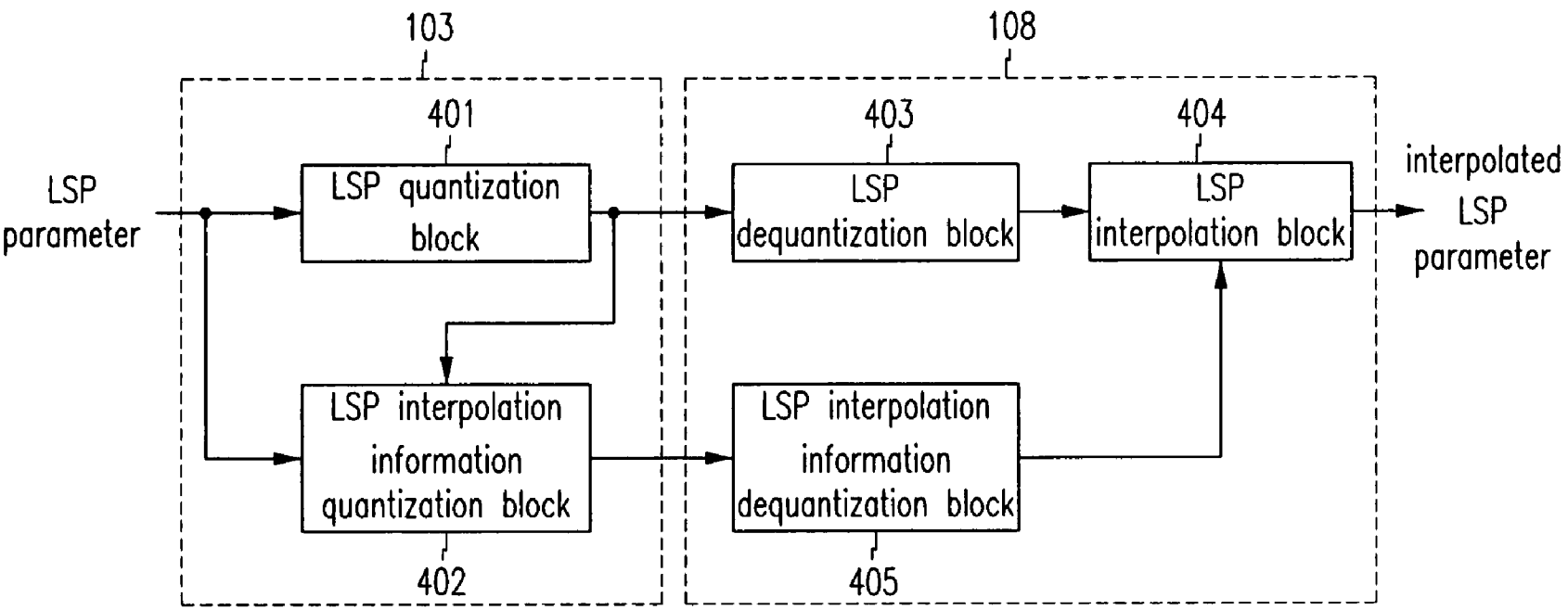
FIG. 4 illustrates another embodiment of a quality enhancement coder and a quality enhancement decoder shown in FIG. 1.

In FIG. 4, another embodiment of a quality enhancement coder and a quality enhancement decoder shown in FIG. 1 is illustrated.

In a speech coder having a relatively long frame length, such as a G.723.1 coder, a change of speech spectrum arises seriously since the time duration among continuous frames is very large. A conventional speech coder does not transmit an LSP parameter at every sub-frame to realize a low bit transmission rate. More specifically, the conventional speech coder transmits LSP information of the last sub-frame in frame units. In addition, the conventional speech coder performs linear interpolation with respect to LSP information of a previous frame and the transmitted LSP information in other sub-frames, and uses the result of linear interpolation as LSP information. However, the conventional speech coder has a problem in that spectrum distortion arises in comparison with the original speech since it uses LSP parameters by performing linear interpolation with respect to quantized LSP information transmitted in units of frames in each sub-frame. In this case, the degree of improvement in quantization performance is not large because of distortion generated in the interpolation procedure, even though the cascaded quantization method illustrated in the LSP error quantization block 201 of FIG. 2 is used for improvement in quantization performance. Therefore, in order to improve quantization performance, it is preferable to use additional bits in the interpolation procedure while maintaining bit compatibility with the conventional standard speech coder.

As shown in FIG. 4, the quality enhancement coder 103 comprises an LSP quantization block 401 and an LSP interpolation information quantization block 402. In addition, the quality enhancement decoder 108 comprises an LSP dequantization block 403, an LSP interpolation block 404, and an LSP interpolation information dequantization block 405.

The input signal of the LSP quantization block 401 is an LSP parameter l(m) for quantizing LPC information obtained at the standard speech coder 102, and the output signal of the LSP quantization block 401 is an LSP parameter l'(m) that has undergone the quantization procedure. In the present embodiment, the LSP interpolation information quantization block 402 has been further provided, and thus performance of the LSP interpolation procedure in a receiver may be improved. The LSP interpolation information quantization block 402 uses additional bits to minimize parameter errors between the LSP parameter l.sub.i(m) obtained at each sub-frame of the standard speech coder 102 and the LSP parameter l.sub.i'(m) obtained through the quantization procedure and the interpolation procedure.

The quantization procedure using additional bits may be realized through several methods. The first method is to perform a scalar quantization procedure or vector quantization procedure once more with respect to the error signal (l.sub.i (m)-l.sub.i'(m)). The second method is to obtain an optimal interpolation function and quantize the interpolation function directly. The third method is to preset all the possible interpolation functions and then select an optimal interpolation function from among them to quantize and transmit only the index of the optimal interpolation function. The first and the second methods are excellent in quantization performance, and the third method is appropriate for realization of a low bit transmission rate.

The LSP dequantization block 403 performs the dequantization procedure by using the transmitted LSP index, and it generates LSP parameters. The LSP interpolation block 404 generates interpolated LSP parameters by using LSP interpolation information obtained at the LSP interpolation information dequantization block 405.

Figure 5:
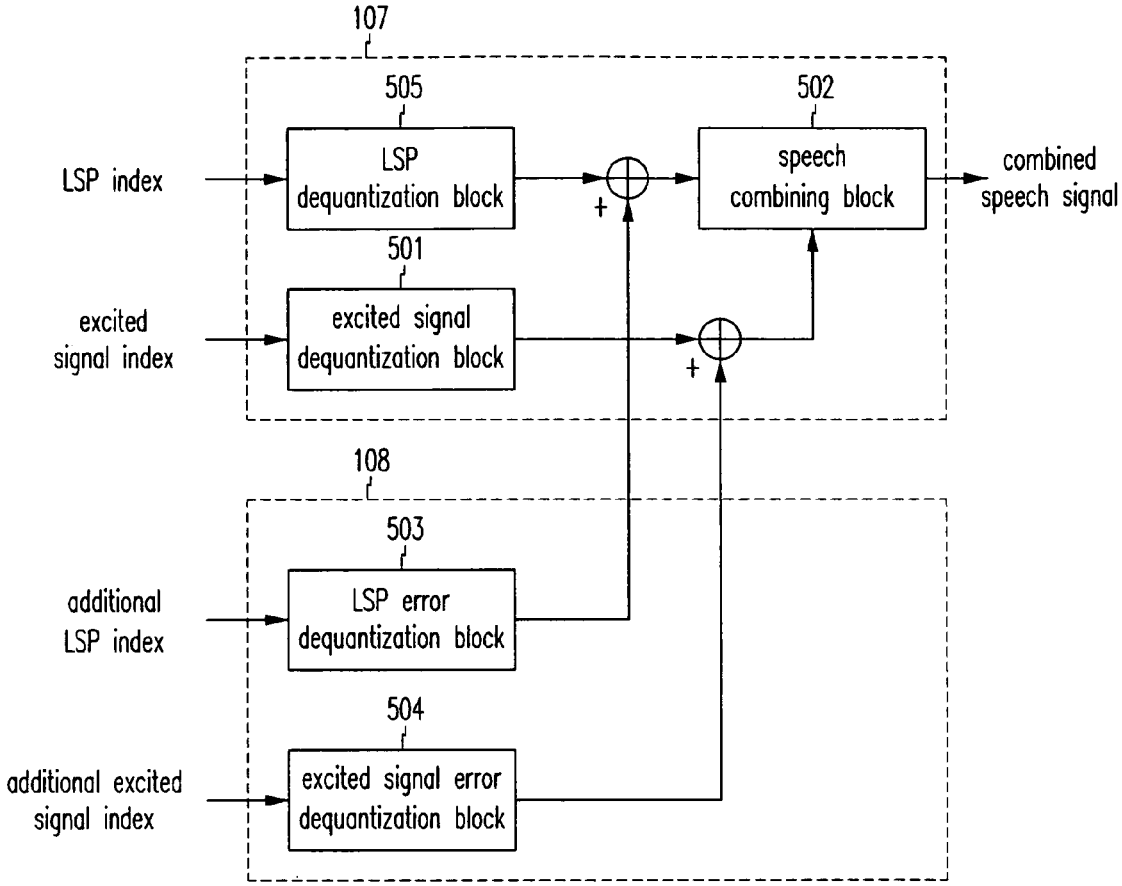
FIG. 5 illustrates a detailed configuration of the receiver shown in FIG. 1.

Next, operation of the receiver will be described with reference to FIG. 5. In FIG. 5, a detailed configuration of the standard speech decoder 107 and the quality enhancement decoder 108 is illustrated.

As shown in FIG. 5, the standard speech decoder 107 comprises an LSP dequantization block 505, an excited signal dequantization block 501, and a speech combining block 502. In addition, the quality enhancement decoder 108 comprises an LSP error dequantization block 503 and an excited signal error dequantization block 504.

The standard speech coder 107 and the quality enhancement decoder 108 are coupled to each other and perform the dequantization procedure with respect to LSP parameter information and the excited signal, and thus combine speech signals through the dequantization procedure. Finally, combined speech having an improved toll quality may be restored. Initially, the LSP dequantization block 505 receives the LSP index and performs a dequantization procedure to restore the LSP parameter. The LSP error dequantization block 503 receives the LSP error index and performs the dequantization procedure to restore the quantization error component of the LSP parameter. The restored LSP parameter and the quantization error component are combined and used as parameters for representing the vocal tract function of speech, in the speech combining block 502. Meanwhile, the excited signal dequantization block 501 receives the excited signal index and performs the dequantization procedure to restore the excited signal. The excited signal error dequantization block 504 receives the additional excited signal index and performs the dequantization procedure to restore the error component of the excited signal. The restored excited signal and the error component of the excited signal are combined and processed in the speech combining block 502, to obtain an excited signal having an improved quality. In other words, the speech combining block 502 restores a speech signal having an improved quality by using a quality enhanced LSP parameter and an excited signal.

As described above, the transmitter and the receiver according to the present invention realize a voice communication service of a high quality by using additional bits permitted in system requirements, while using a conventional speech coder as it is. In addition, the transmitter and the receiver according to the present invention are advantageous in that they enable insertion of additional quantization blocks while not changing the structure of the conventional standard speech coder, since they allocate additional bits by applying a multi-stage quantization procedure not in a speech signal domain but in a parameter domain.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. Speech encoding method in a transmitter by using an additional bit allocation, comprising:

dividing the speech signal into spectrum information and an excited signal component and generating standard coded bit streams by performing modeling, quantizing, and coding with respect to the spectrum information and the excited signal;

obtaining errors between the quantized signal and the unquantized signal with respect to the excited signal component, and generating a coded bit streams by performing additional quantization with respect to the obtained errors; and multiplexing the bit streams obtained at each of the coders and transmitting the multiplexed bit streams to a receiver.

2. The method according to claim 1, wherein the obtaining errors comprising: quantizing the errors by using an additional bit to perform multi-stage quantization.

3. The method according to claim 1, wherein the obtaining errors comprising: using an algebraic codebook for the additional quantization.

4. The method according to claim 1, wherein the obtaining errors comprising: obtaining an error between the quantized signal and the unquantized signal with respect to the spectrum information, and generates a coded bit stream by performing the additional quantization with respect to the obtained error.

5. The method according to claim 4, wherein the obtaining errors comprising: performing the additional quantization with respect to a predetermined part of the spectrum information in accordance with quantization performance.

6. The method according to claim 4, wherein the spectrum information is an LSP (Line Spectrum Pair) parameter, wherein the obtaining errors comprising:

receiving an unquantized LSP parameter and a quantized LSP parameter from the standard speech coder and performing a quantization procedure with respect to errors of the two LSP parameters; and receiving an unquantized excited signal and a quantized excited signal from the standard speech coder and performing a quantization procedure with respect to errors of the two excited signals.

7. The method according to claim 6, wherein the obtaining errors comprising: minimizing parameter errors between the LSP parameter obtained at each sub-frame of the standard speech coder and the LSP parameter obtained through a quantization procedure and an interpolation procedure by using additional bits.

8. Speech decoding method in a receiver by using an additional bit allocation, comprising:

demultiplexing bit streams of the speech signal to generate an LSP (Line Spectrum Pair) index, an excited signal index and an additional excited signal index to compensate the error of an excited signal component of the speech signal;

generating error components of the excited signal by performing a dequantization procedure with respect to the additional excited signal index; and performing a dequantization procedure with respect to the LSP index and the excited signal index, and restoring the speech signal based on the dequantized LSP index, the dequantized excited signal index, and the error component of the excited signal.

9. The method according to claim 8, wherein the spectrum information is an LSP parameter, wherein the performing a dequanitzation procedure comprising: receiving the LSP index from the demultiplexed bit streams of the speech signal and restoring the LSP parameter by performing a dequantization procedure with respect to the LSP index;

receiving the excited signal index from the demultiplexed bit streams of the speech signal and restoring the excited signal by performing a dequantization procedure with respect to the excited signal index; and combining the restored excited signal component and the error component of the excited signal and restoring the speech signal by processing the combined signal and the restored LSP parameter.

10. The method according to claim 8, wherein the spectrum information is an LSP parameter, wherein the performing a dequantization procedure comprising: receiving the LSP index from the demultiplexed bit streams of the speech signal and restoring the LSP parameter by performing a dequantization procedure with respect to the LSP index;

receiving the excited signal index from the demultiplexed bit streams of the speech signal and restoring the excited signal by performing a dequantization procedure with respect to the excited signal index; and respectively combining error components of the spectrum information and the excited signal into the restored LSP parameter and the excited signal and restoring the speech signal by processing the two combined signals.

* * * * *